United States Patent [19]

Ishii

[11] 4,178,848

[45] Dec. 18, 1979

[54] AUTOMATIC PLATE SUPPLYING DEVICE FOR USE IN AN OFFSET PRINTING MACHINE

[75] Inventor: Koji Ishii, Fuchu, Japan

[73] Assignee: Ryobi Ltd., Hiroshima, Japan

[21] Appl. No.: 806,127

[22] Filed: Jun. 13, 1977

[30] Foreign Application Priority Data

Jun. 14, 1976 [JP] Japan ..... 51/70021

[51] Int. Cl.[2] ..... B41F 7/00; B41F 21/06; B65H 3/08

[52] U.S. Cl. ..... 101/142; 101/132.5; 271/101; 271/108

[58] Field of Search ..... 101/132, 132.5, 141, 101/142, 144; 271/99-101, 108

[56] References Cited

U.S. PATENT DOCUMENTS

| | | | |
|---|---|---|---|
| 2,704,209 | 3/1955 | Halahan et al. | 271/101 X |
| 2,982,070 | 5/1961 | Lyon et al. | 271/100 X |
| 3,807,303 | 4/1974 | Petersen | 101/132.5 |
| 4,008,660 | 2/1977 | Hooper et al. | 101/132 |
| 4,009,876 | 3/1977 | Smiltneek | 271/108 X |

FOREIGN PATENT DOCUMENTS

| | | | |
|---|---|---|---|
| 369418 | 2/1923 | Fed. Rep. of Germany | 271/100 |

*Primary Examiner*—Clyde I. Coughenour
*Attorney, Agent, or Firm*—Sughrue, Rothwell, Mion, Zinn and Macpeak

[57] ABSTRACT

An automatic plate supplying device for supplying plates to an offset printing machine is disclosed, which operates to sequentially supply original plates to an original plate conveying device adapted to feed original plates to a plate cylinder provided in the printing machine. A pivotable suction means removes plates from the bottom of a stack for delivery to the machine.

15 Claims, 7 Drawing Figures

AUTOMATIC PLATE SUPPLYING DEVICE FOR USE IN AN OFFSET PRINTING MACHINE

BACKGROUND OF THE INVENTION

This invention relates to a plate supplying device which operates to automatically supply original printing plates (hereinafter referred to merely as "plates" when applicable) to rotary offset printing machines, or the like.

Recently, there has been a strong need to quickly print considerable amounts of different information.

Printing machines have been developed which are capable of automatically loading a plate on a plate cylinder, supplying printing sheet, suspending the sheet supply upon completion of the printing, inking a rubber cylinder with a plate cylinder, cleaning residual ink on the blanket cylinder, etc.

In a conventional plate supplying device for supplying plates to the conventional printing machine in sequence, a plurality of rollers are arranged on plates stacked on a table, and the plates are delivered to a plate-feeding device successively starting from the top plate by depressing and turning the rollers. However, the plate supplying device of this type suffers from disadvantages that frictional damage to plates due to the rotation of the rollers and errors in supplying the plates due to unsatisfactory friction between the rollers and the plate are liable to be caused. In case additional plates should be loaded the plates stacked on the table, the additional plates must be placed under the old plates, otherwise the plate supplying order is confused. Furthermore, in this case, the provision of the plate delivering device such as the rollers disposed above the plates on the table is a great obstruction in loading plates on the table. In addition, in this plate supplying device, whenever the plate is delivered out by the rotation of the rollers, the height of the stack of plates is decreased. Therefore, it is necessary to provide a means for raising the table, etc. with the delivery of the plates.

SUMMARY OF THE INVENTION

An object of this invention is to eliminate the above-described difficulties inherent to the plate supplying device of the conventional printing machine. According to the present invention, the above object can be achieved by providing a novel plate supplying device in which a separator for supporting front end portions of plates is provided in front of a table on which the plates are stacked, to form a plate feeding window between the table and the separator, and a suction foot mechanism adapted to suitably reciprocate between the window and a plate feeding device provided below the window and to suck and retain the lowest plate only in its stroke from the window to the plate feeding device, and in which a shutter is adapted to selectively open the window so that the plates stacked on the table are delivered through the window to the original plate feeding device successively starting from the lowest one of the plate, whereby the plates can be supplied without damage and additional plates can be loaded on the table even for the period of time during which the plates are being delivered out.

BRIEF DESCRIPTION OF THE DRAWINGS

In drawings.

DETAILED DESCRIPTION OF THE INVENTION

A preferred embodiment of a plate supplying device according to this invention will be described in detail with reference to the accompanying drawings.

Figures 1, 3:
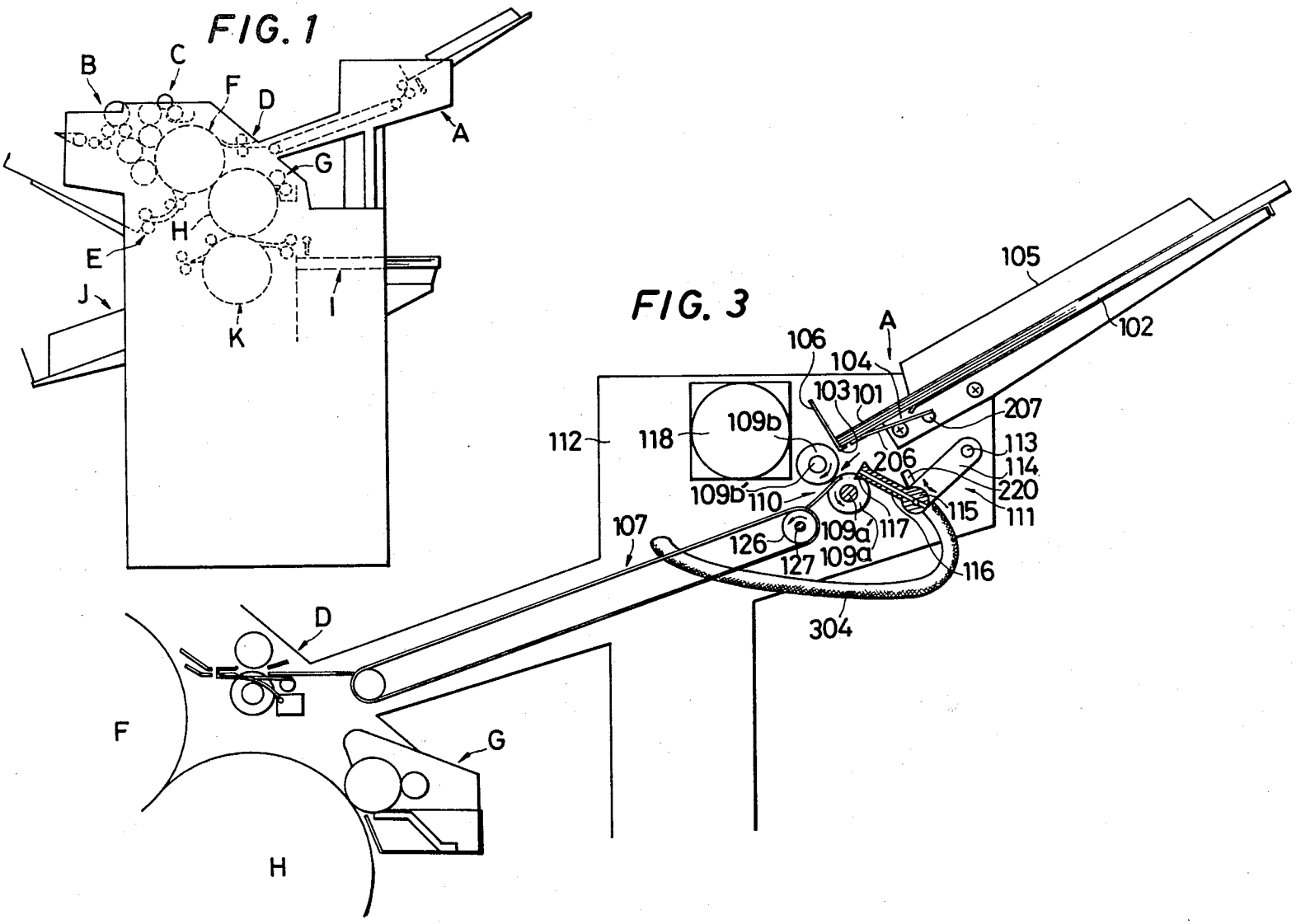
FIG. 1 is a schematic side view illustrating the arrangement of a plate supplying device according to this invention.
FIG. 3 is a sectional side view showing essential parts of one example of the plate supplying device according to the invention.

FIG. 1 which shows a side view of a complete rotary offset printing machine with main components shown by dotted lines and designated by capital letters. The printing machine comprises a plate supplying device A, a plate cylinder F, an inking device B, a humidity supplying device C, a plate feeding device D and a plate removing device E, a blanket cylinder H having a cleaning device G in its vicinity, a sheet supplying device I, and a pressure cylinder K and a heat removing device J. All components of the printing machine except the plate supplying device A are known and detailed explanations thereof are omitted.

The plate supplying device A according to the present invention is designed so as to automatically supply the plates to the plate feeding device D in response to a suitable plate supplying command signal, and it is, in general, provided obliquely above the plate feeding device.

Figure 2:
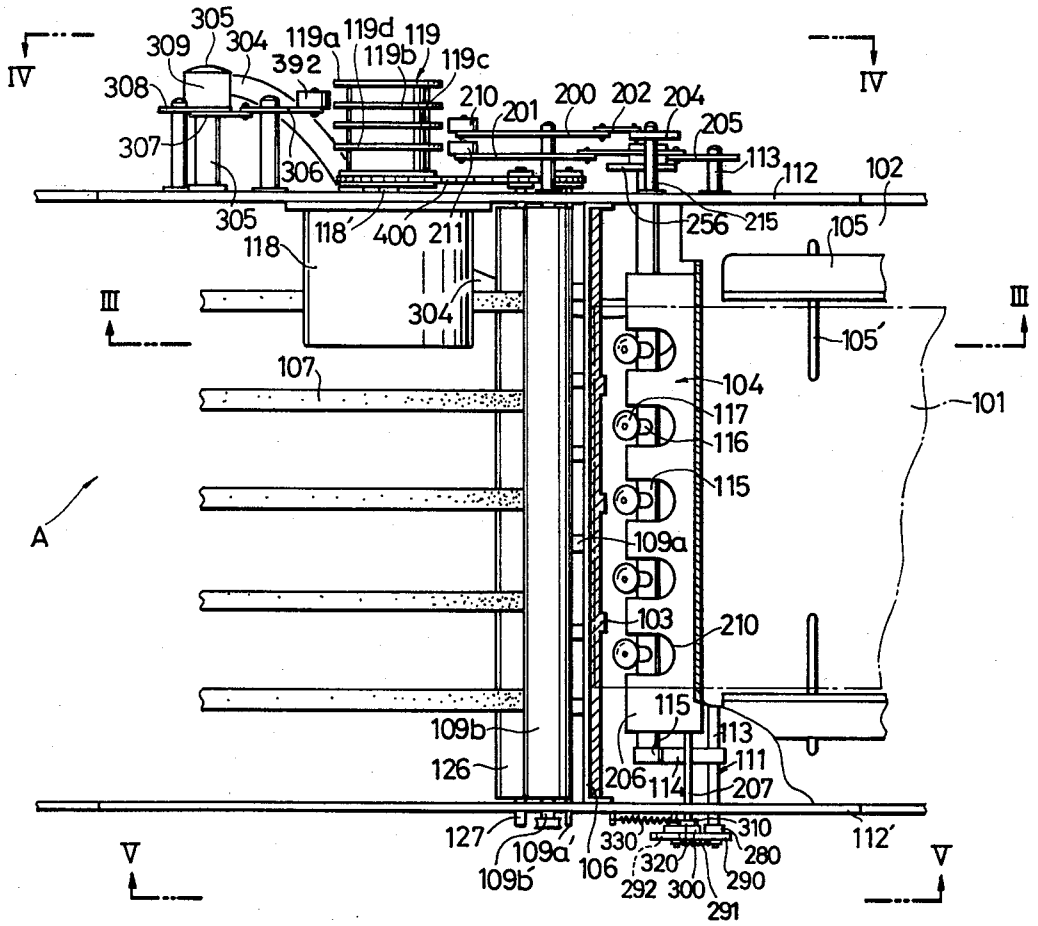
FIG. 2 is a front view showing an essential part of the invention.

FIG. 2 is a top view of the plate supplying device A. In FIG. 2, a table 102 is provided obliquely and supported between the side walls 112 and 112'. The table 102 is inclined toward the plate feeding section D, and serves to receive the plates 101 thereon. The front ends of the plates 101 are regulated by a guide wall 106 provided on the extension line of the table 102 and are prevented from dropping by a plurality of tabs 103 provided on the lower edge of the guide wall 106. A plate delivering window 104 is formed between the wall 106 and the front end of the table 102.

Side guides 105 are provided on the upper surface of the table 102 to regulate the positions of the plates 101 in widthwise directions. The side guides 105 are regulatable along slots 105' to accomodate various plate sizes. The plate delivering window 104 is substantially closed by a flap 206 fixed to a shaft 207 pivotably supported by the side walls 112 and 112'. The flap 206 is formed with a plurality of recesses 210. Below and in front of the window 104, there is provided a conveying device 110 which comprises a plurality of driving rollers **109*a*, a driven roller 109*b* and a guide 108. A suction foot mechanism 111 is provided below the flap 206**.

The suction foot mechanism 111 comprises a shaft 113 rotatably supported by the frame 112 and 112' and a suction pipe 115 having arms 114 at the opposite end thereof, respectively. The suction pipe 115 is formed with a plurality of hollow suction feet 166 fixedly connected to the pipe 115 in fluid communication therewith and at the same intervals as those of the recesses of the flap 206. Suckers 117 are provided on the top ends of the suction feet 116, respectively. The arms 114 are rotatable with respect to the suction pipe 115. The arms 114 are fixed to the shaft 113 so that the suction pipe 115 can be rotated about the shaft 113 with rotation of the latter. One end of the suction pipe 115 has an extension which presses through a slot provided in one of the frames, in the illustrated embodiment, the frame 112. The shape and size of the slot is determined such that the extension of the suction pipe 115 is not obstructed.

Under the normal condition, the flap 206 is locked to close the window 104.

The relative arrangement of the above described components will become more clear by referring FIG. 2 together with FIG. 3 which is a cross sectional side view of the device A taken along the line III—III in FIG. 2.

The plates 101 are stacked on the inclined table 102 and the front edges of the plates are supported by the end plate 106 and the tabs 103 thereof. The flap 206 is pivotably supported by the shaft 207.

The suction feet 116 each having one end formed with the sucker 117 are secured to the hollow suction pipe 115 in fluid communication therewith. The suction pipe 115 is connected to a vacuum source through a hose 304. The suction pipe 115 is rotatably supported by one end of each of a pair of arms 114 whose other ends are rotatably supported by shaft 113.

Under the normal condition the suction feet 116 are held at upraised portions with respect to the arms 114 and when the arms 114 reaches the end of the downward swing thereof, pivoted forwardly to bring the sucker 117 to a suitable position to feed the sheet to be sucked by the sucker an area between the driving rollers **109*a* and the driven roller 109*b***.

The driving rollers **109*a* are supported by a driving shaft 109*a*' rotatably supported by the side frames 112 and 112' and driven through a chain 400 which is driven by a sprocket 119 mounted on a shaft 118' of a motor 118**.

Between the area defined between the driving rollers **109*a* and the driven roller 109*b* and the conveyer mechanism composed of a plurality of belts 107 driven by a roller 126 whose shaft 126 is also driven through the chain 400, a guide plate 108 is disposed to facilitate the feeding of the plate onto the conveyer belts 107**.

Figure 4:
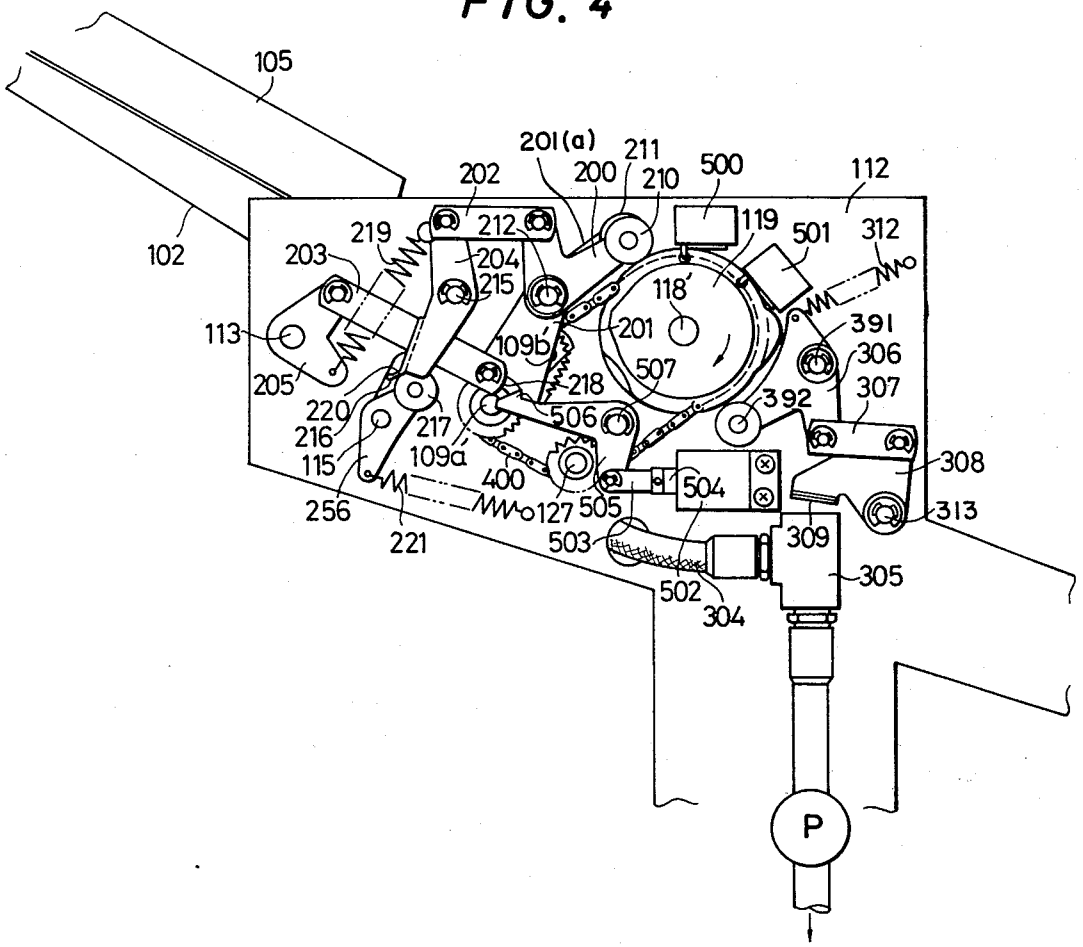
FIG. 4 is a side view illustrating the driving mechanism of the plate supplying device.

FIG. 4 is a side view of the device A taken along a line IV—IV in FIG. 2, which shows a link mechanism to properly operate the above mentioned components.

In FIG. 4, the chain 400 driven by the sprocket 119 mounted on the shaft 118' extending from the motor 118 mounted on the inside of the frame 112 drives pulleys mounted on the shaft **109*a*' of the driving roller 109*a* and the shaft 127 of the conveyer roller 126. The sprocket 119 is coaxially formed with four cams 119*a* to 119*d*** stacked in that order.

The cam **119*a* is adapted to be contacted with a roller engageable with a pair of switches 500 and 501 and contoured such that, with a rotation thereof in the direction of the arrow. The switch 500 is firstly operated to energize a solenoid 502 to retract a plunger 503 thereof against a return spring 504 and slightly thereafter the switch 501 is operated to deenergize the solenoid 502**.

The cam **119*b* is adapted to be contacted with a roller 310 mounted on a first one of the arms of a pivot lever 306 supported pivotally by a shaft 391. A second arm of the lever 306 is spring biased by a spring 312 such that the roller 302 is urged to the arm surface of the cam 119*b*. A third arm of the lever 306 is connected by a link 307 to one end of a lever 308 supported pivotably by a shaft 313. A flat closure 309 is formed on the outer end of the lever 308. The closure 309 is adapted to selectively close an atmospheric bleed hole of a vacuum member 305 to generate a negative pressure in the hose 304 connected to the suction pipe 115 and the suckers 117**.

The cam **119*c* is adapted to be contacted with a roller 210 mounted on one arm of a lever 200 supported pivotably by a shaft 212. The other arm of the lever 200 is connected by a link 202 to one end of a lever 204 pivotably supported by a shaft 215. The other end of the lever 204 is formed with a guide 216** to be described later.

The cam **119*d* is adapted to be contacted with a roller 211 mounted on one end of a lever 201(*a*) pivotably supported by a shaft 212. The other end of the lever 201(*a*) is formed with a protrusion 218 and is connected to one end of a lever 205 by a link 203. The lever 205 is pivotably supported by the shaft 113 and has the other end biased by a spring 219 such that the roller 211 is urged to the cam 119*d*. The protrusion 218 of the other end of the lever 201(*a*) is usually hooked by a hook 506 provided in one end of a lever 505 pivotably supported by a pin 507. The other end of the lever 505 is connected to the end of the plunger 503 of the solenoid 502**.

An extension of the suction pipe 115 passes through a slot opening 220 provided in the side frame 112. A lever 256 is secured to the end of the extension 115 and has one end provided with a roller 217. The other end of the lever 256 is biased by a spring 221.

The roller 217 is in slide contact with the guide 216 of the lever 204. The spring 221 functions to maintain the slide contact between the roller 217 and the guide 216.

Figure 5:
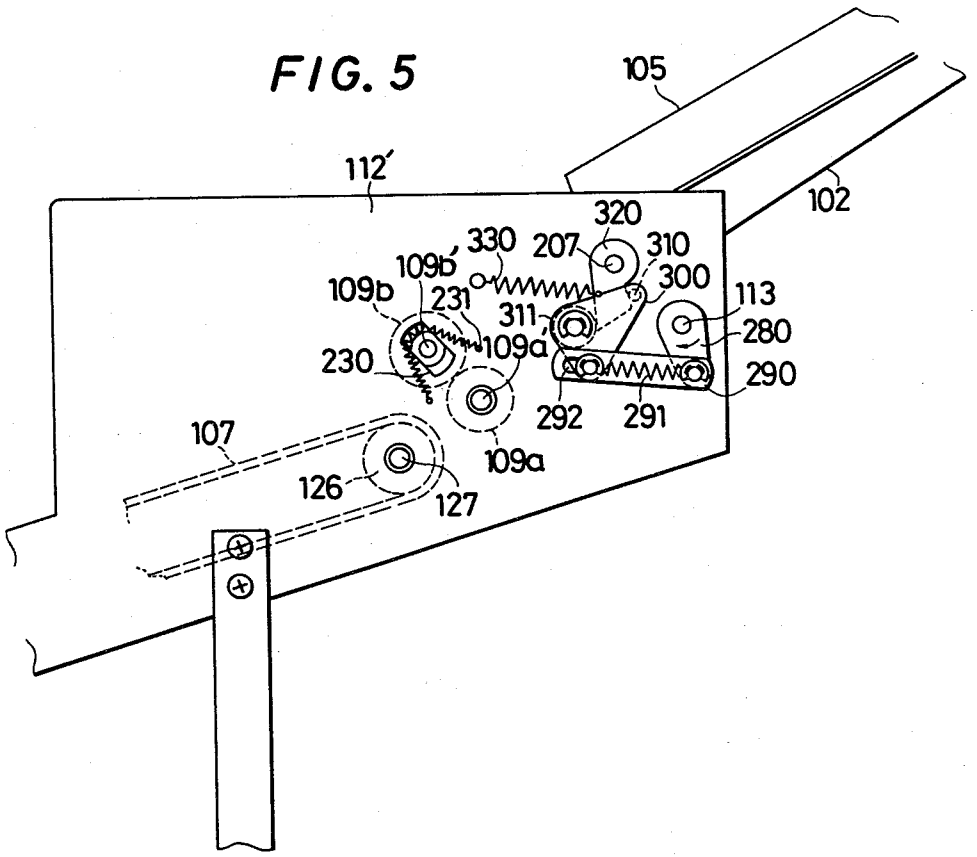
FIG. 5 is a side view showing the operative coupling mechanism between a suction foot mechanism and a shutter.

The both end portions of the shaft **109*b*' of the driven roller 109*b* are received by slot 230 in FIG. 5 provided in the side frames 112 and 112' and biased by spring 231 such that the roller 109*b* is urged to the driving roller 109*a***.

FIG. 5 is a side view of the device A taken along a line V—V in FIG. 2. In FIG. 5, a nail member 320 is secured to the shaft 207 of the flap 206. The nail member 320 is biased clockwise direction by a spring 330 so that the flap 206 is normally maintained in the position in which it closes the window 104.

A lever 300 is pivotably supported by a pin 311 and has one end provided with a pin 310 extending toward the frame 112' and the other end connected through a link 290 to a lever arm 280 secured to the shaft 113. The other end of the lock lever 300 and the lever arm 280 are suitably biased by a spring 291 so that the distance therebetween is usually maintained constant.

The pin 310 of the lock lever 300 engages with the nail member 320 so that the latter and hence the flap 206 are locked in the window-closing-position and, when the lever arm 280 is moved clockwise due to the clockwise rotation of the shaft 113 and hence the suction pipe 115, the lock lever 300 is also rotated clockwise and the locking of the nail member 320 is released to enable the nail member and hence the flap 206 to rotate counterclockwise in FIG. 3 to open the window.

The operation of the device A of the present invention will now be described with reference to FIGS. 2, 3, 4 and 6.

When an electric start signal is applied to the motor 118 by a manual push button or a suitable program control (not shown), the motor 118 is started to rotate. Upon the actuation of the motor 118, the cams 119*a* to 119*d* are rotated in the arrow direction (FIG. 4) and therefore the shafts 109*a'* and 127 of the rollers 109*a* and the conveyer roller 126, respectively, start to rotate by the rotation of the sprocket 119.

Figure 6B:
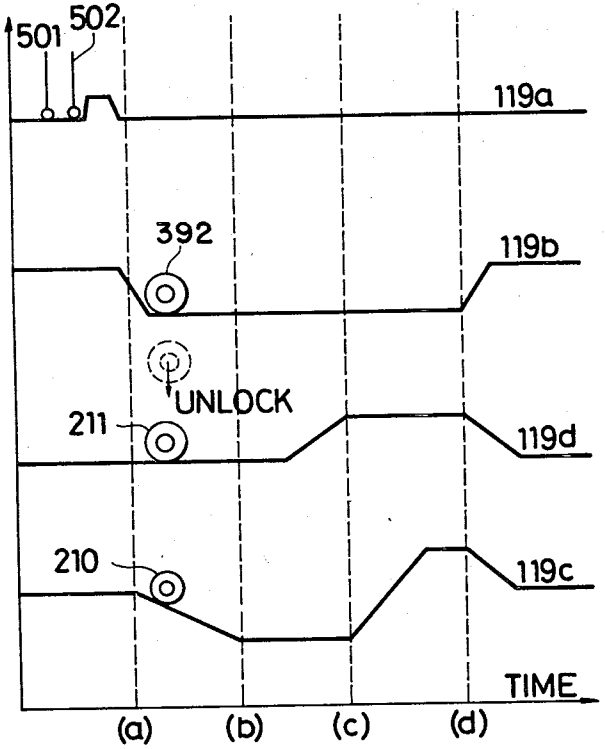
FIG. 6B is a diagram showing the shape of cam surfaces.

The relation of the cam surfaces of the cams 119*a* to 119*d* is schematically shown on straight lines in FIG. 6B, together with the relative positions of the switches 500 and 501 and the rollers 210, 211 and 392 with respect to the cams for explanatory purpose. In FIG. 6B, the rollers are shown as moved rightwardly with the cams being stationary.

At a certain time point after the starting of the rotations of these components, the roller 392 contacts with a reduced diameter portion of the cam 119*b* to rotate the lever 306 clockwise. This will cause the closure 309 to close the atmospheric bleed hole of the vacuum member 305. Therefore, a negative pressure is applied to the suction members 117 through the hose 304, the suction pipe 115 and the suction feet 116. At substantially the same time, the switch 500 is actuated by the cam 119*a* to actuate the solenoid 502. Upon the actuation of the solenoid 502, the plunger 503 thereof is retracted against the return spring 504 to rotate the lever 505 around the pin 507 to thereby release the hooking of the hook 506 on the protrusion 218 of the lever 201. Upon the unhooking, the lever 205 secured to the shaft 113 is permitted to rotate counterclockwise by the biasing spring 219. Meanwhile a roller 210 follows the cam surfaces 119*c* to rotate the lever 200 clockwise. The clockwise rotation of the lever 200 is transmitted through the link 202, lever 204 and the roller 217 to the lever 256 to permit the latter to rotate counterclockwise by the biasing force of the spring 221, to thereby rotate the suction pipe 115 counterclockwise shown in FIG. 6A.

With the counterclockwise rotation of the lever 205, the lever 201 is rotated clockwise through the link 203 to thereby make the roller 211 thereof in contact with the cam 119*d*.

Figure 6A:
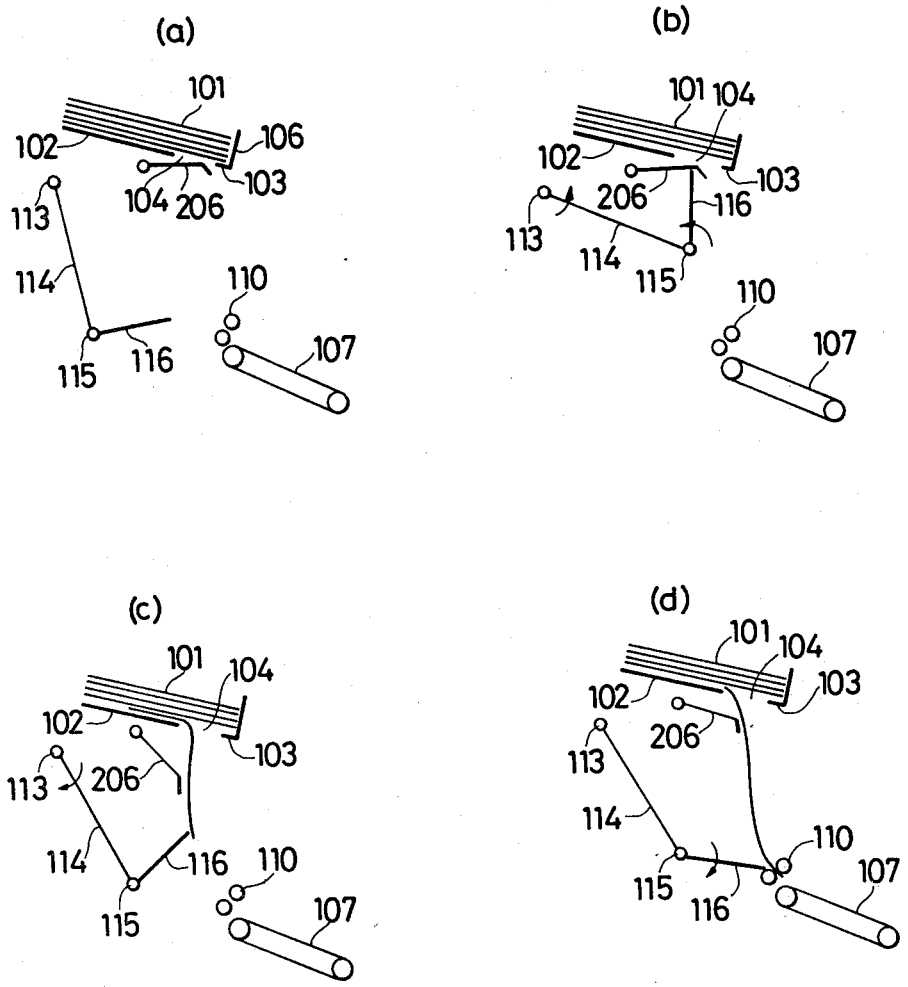
FIG. 6A shows a diagram for an explanation of operation of the mechanism shown in FIG. 5.

The position of the suction feet 116 at this time is shown in FIG. 6A(b). The suction feet 116 pass through the recesses 210 of the flap 206 and the suction members 117 contact with the lower surface of the lowest plate. Since the negative pressure is applied to the suction members 117, the latter suck the lowest plate.

The clockwise rotation of the shaft 113 in FIG. 5 also serves to rotate the lever 300 clockwise through the link 290 to thereby release the locking of the nail member 320 and hence the shaft 207 and the flap 206, so that the flap 206 is rotated by the weight of plates against the biasing force of the spring 330.

Upon a further rotation of the cam 119, the roller 211 rides on cam surface of the cam 119*d* as shown in FIG. 6B, so that the lever 201 is rotated counterclockwise to thereby rotate the lever 205 and hence the shaft 113 through the link 203. Upon the rotation of the shaft 113, the suction pipe 115 swings clockwise along the slot 220 with the lowest plate sucked by the suction members 117 as shown in FIG. 6A(cc).

At the time when the suction pipe 115 reaches the lowest postion, the roller 210 begins to ride on the surface of the cam 119*c* as shown in FIG. 6B, to rotate the lever 200 counterclockwise. The anticlockwise rotation of the lever 200 is transmitted through the link 202, the lever 204 and the roller 217 to the lever 256 to allow the latter to rotate clockwise against the biasing force of the spring 221, to thereby rotate the pipe 115 clockwise as shown in FIG. 6A.

Upon the clockwise rotation of the lever 206, the suction pipe 115 is rotated clockwise to bring the suction members 117 and hence the sucked plate to the space between the rollers 109*a* and 109*b* as shown in FIG. 6A(*d*).

At this time the roller 310 rides on the larger diameter portion of the cam 119*b* to rotate the lever 308 and hence the closure 309 thereof to thereby open the vacuum member 305 and remove the negative pressure at the suction members 117. Therefore, the plate is released and allowed to be conveyed.

After the removal of the negative pressure from the suction members 117, the roller 210 returns to its initial state, so that the lever 256 also returns to its initial state shown in FIG. 6A(*a*).

Since the shutter provided for the original plate feeding window is opened for the plate feeding period during which the suction foot mechanism is operated, but it is closed for the other period of time, when the shutter thus closed is locked. A careless feed or transfer of the plate through the window is prevented. Furthermore, the suction foot mechanism having the suckers operated to suck and retain the plate only when the plate is fed through the window, that is, it does not suck the plate for the other period of time, and therefore the transfer of the plate from the window to the conveying device (or the original plate feeding device) can be smoothly carried out.

Thus, as is apparent from the above description, in this invention, the plates loaded on the table are transferred to the original plate feeding device by the suction foot mechanism in response to the plate supplying command signals successively starting from the lowest one of the plates thus stacked. Therefore, unlike the conventional method employing rollers for conveying or supplying the plates, frictional damage to plates or errors in supplying plates will never be caused in the plate supplying device according to this invention. Furthermore, even if additional plates are stacked on the plates which has been loaded on the table, the plate supplying order is maintained unchanged. As the plate feeding position is also maintained unchanged at all times, it is unnecessary to provide a lifting device for the table. Thus, the plate supplying device according to this invention is simple in construction and is capable of positively and smoothly supplying printing plates, and therefore, it can be conveniently employed as a plate supplying device for equipment such as a printing machine and an etching which need the supply of original plates.

In the embodiment of the invention, the operative coupling of the suction foot mechanism, and the operative coupling between the suction foot mechanism and the shutter are achieved mechanically. However, it is not always necessary to achieve these coupling mechanically. That is, it goes without saying that the coupling may be achieved by the use of, for instance, a hydraulic pressure circuit, an air circuit, or an electrical circuit. Furthermore, for instance, with respect to the plate supplying command signal, a program control or a manual control together with various command signals of a printing machine or the like can be employed as starting means.

What is claimed is:

1. An automatic plate supplying device for suplying plates sequentially to an offset printing machine including a pair of side walls, a drive motor disposed at one of the side walls and a plate conveying means driven by said motor, comprising:

(a) a plate storing means for supporting the plates in a stack having a bottom plate, said plate storing means being formed with a normally substantially closed opening through which the plates are to be drawn sequentially, (b) a swingable suction means for sucking the bottom plate and transporting it to said conveying means, said swingable suction means comprising a pivotable member having a pivoting end and a swinging end, a swingable suction pipe in communication with a negative pressure source and mounted on the swinging end of said pivotable member, and a plurality of suction feet supported by said suction pipe in fluid communication therewith, said suction pipe and suction feet being rotatable with respect to said pivotable member, (c) means for actuating said suction means to swing it between said plate storing means and said plate conveying means, and (d) cam means driven by said driving motor for operating said swingable suction means and said means for actuating said suction means.

2. An automatic plate supplying device as defined in claim 1, wherein said opening of said plate storing means is normally substantially closed by a swingable flap.

3. An automatic plate supplying device as defined in claim 2, further comprising a first locking means for normally locking said flap to prevent the latter from being opened.

4. An automatic plate supplying device as defined in claim 1, wherein said means for actuating said suction means comprises a first means for intermittently communicating said swingable suction means with said negative pressure source, a second means for swinging said swingable suction means and a third means for rotating said suction pipe and suction feet relative to said pivotable member.

5. An automatic plate supplying device as defined in claim 4, wherein said negative pressure source includes a vent opening which, when open, disables said negative pressure source, and wherein said first means comprises a closure to close said vent opening to permit negative pressure communication between said swingable suction means and said negative pressure source, said closure being actuated during movement of said suction means between said plate storing means and said plate conveying means.

6. An automatic plate supplying device as defined in claim 4, wherein said second means comprises a first lever pivotable about a shaft secured to one of the side walls, and a second lever coupled to said first lever and said suction pipe for rotating the latter in response to the pivot of said first lever.

7. An automatic plate supplying device as defined in claim 4, further comprising a control means for controlling said third means so as to rotate said suction pipe and suction feet when said suction pipe is adjacent said plate storing means and when said suction pipe is adjacent said plate conveying means.

8. An automatic plate supplying device as defined in claim 4, wherein said cam means comprises a first cam for controlling said second means, a second cam for controlling said third means and a third cam for controlling said first means.

9. An automatic plate supplying device as defined in claim 6, further comprising a locking means for locking said first lever when the negative pressure application to said suction pipe is terminated.

10. An automatic plate supplying device as defined in claim 9, further comprising a spring for biasing said second lever for rotation, wherein said locking means comprises a solenoid having a spring biased plunger, a third lever having one end formed with a hook and the other end pivotally connected to said plunger, and a projection provided at the one end of said first lever engagable with said hook, upon disengagement of the hook from the projection by the solenoid said second lever being rotated by the biasing force of the spring whereby said suction pipe is swung toward said plate storing means.

11. An automatic plate supplying device as defined in claim 10, wherein said cam means includes a first cam and wherein one end of said first lever follows said first cam upon disengaging said hook from said projection to swing back said suction pipe.

12. An automatic plate supplying device as defined in claim 8, further comprising a fourth cam to actuate said solenoid means.

13. An automatic plate supplying device as defined in claim 12, wherein said first, second, third and fourth cams are coaxially mounted on a rotatable member which is driven by said driving motor.

14. An automatic plate supplying device as defined in claim 3, wherein said first locking means comprises a nail member rotatable with rotation of said flap and biased by a spring to normally maintain said flap in the position in which said window is closed, a lever arm rotatable in synchronism with said suction pipe, and a lock lever coupled to said lever arm for selectively locking said nail member in said closed position.

15. An automatic plate supplying device as defined in claim 8, wherein said third means comprises a first pivot lever secured to said suction pipe, a second pivot lever having one end slidingly engaged with one end of said first pivot lever, and a third pivot lever having one end coupled to the other end of said second lever and the other end of which is controlled by said second cam means.

* * * * *